US010563372B1

(12) United States Patent
Huang et al.

(10) Patent No.: US 10,563,372 B1
(45) Date of Patent: Feb. 18, 2020

(54) SEA-CROSS HIGH-SPEED TUNNEL STRUCTURE SUSPENDED IN WATER, CONSTRUCTION METHOD AND CONTROL METHOD THEREOF

(71) Applicant: Xiayi Huang, Fuzhou (CN)

(72) Inventors: Xiayi Huang, Fuzhou (CN); Chang Xia, Fuzhou (CN); Bin Huang, Fuzhou (CN); Zhihua Min, Shanghai (CN); Xindi Wang, Shanghai (CN)

( * ) Notice: Subject to any disclaimer, the term of this patent is extended or adjusted under 35 U.S.C. 154(b) by 0 days.

(21) Appl. No.: 16/263,188

(22) Filed: Jan. 31, 2019

(30) Foreign Application Priority Data

Dec. 14, 2018 (CN) ..... 2018 1 1531147

(51) Int. Cl.

| | |
|---|---|
| ***E02D 29/09*** | (2006.01) |
| ***E02D 29/067*** | (2006.01) |
| ***E02D 29/16*** | (2006.01) |
| *E01D 15/14* | (2006.01) |

(52) U.S. Cl.
CPC ..... *E02D 29/06* (2013.01); *E02D 29/067* (2013.01); *E02D 29/16* (2013.01); *E01D 15/14* (2013.01); *E02D 2600/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,329,317 | A * | 1/1920 | Williams | E02D 29/077 405/135 |
| 3,478,521 | A * | 11/1969 | Petrik | B61C 5/00 405/135 |
| 3,797,403 | A * | 3/1974 | Schwarzler | B61B 13/08 104/284 |
| 3,849,821 | A * | 11/1974 | Arild | E01D 15/14 14/27 |
| 3,901,038 | A * | 8/1975 | Olsen | E02D 29/073 405/135 |
| 5,899,635 | A * | 5/1999 | Kuja | E02D 29/067 405/134 |
| 7,942,607 | B2 * | 5/2011 | Bauder | E21D 9/14 405/136 |
| 2016/0278141 | A1 | 9/2016 | Emami et al. | |
| 2017/0233977 | A1 * | 8/2017 | Cole | B01D 61/025 405/136 |
| 2018/0139793 | A1 | 5/2018 | Emami et al. | |

* cited by examiner

*Primary Examiner* — Kyle Armstrong
(74) *Attorney, Agent, or Firm* — Erson IP (Nelson IP)

(57) ABSTRACT

A sea-cross high-speed tunnel structure suspended in water includes a pipe body capable of suspending in water. The pipe body is formed by fixedly connecting a plurality of pipe sections. A reinforced concrete horizontal partition plate for dividing each pipe section to form an upper chamber and a lower chamber is fixed in each pipe section. Two closed tunnels arranged along a length direction of the pipe body are disposed in the upper chamber. Reinforced concrete fin plates are symmetrically disposed in a horizontal direction outside the pipe sections. A steel closed tunnel shell fixed to the reinforced concrete horizontal partition plate is disposed in the upper chamber. A rail bed is disposed in the steel closed tunnel shell. Electromagnetic regulating devices disposed transversely are fixedly connected between both sides of the rail bed and the steel closed tunnel shell.

10 Claims, 9 Drawing Sheets

SEA-CROSS HIGH-SPEED TUNNEL STRUCTURE SUSPENDED IN WATER, CONSTRUCTION METHOD AND CONTROL METHOD THEREOF

CROSS-REFERENCE TO RELATED APPLICATIONS

This application claims priority to Chinese Patent Application No. 201811531147.8 with a filing date of Dec. 14, 2018. The content of the aforementioned applications, including any intervening amendments thereto, are incorporated herein by reference.

TECHNICAL FIELD

The present disclosure relates to a construction method, a control method and a use method of a sea-cross tunnel suspended in water, and in particular to a sea-cross high-speed tunnel structure suspended in water, a construction method and a control method thereof.

BACKGROUND OF THE PRESENT INVENTION

The idea of building a cross-sea vacuum super high-speed railway has been proposed for a long time. In order to achieve this goal, a safe and reliable ocean tunnel shall be constructed at first.

At present, all the constructed ocean tunnels are submarine tunnels. There are two construction methods. The first method is to excavate a hole in a rock layer or a soil layer at a certain depth from the seabed to build a submarine tunnel (excavation method). This method for constructing the submarine tunnel is long in construction period, difficult in construction and high in project cost, such as Channel Tunnel. The other method is to place the segmented prefabricated tubular structure into a surface layer of the seabed or a shallow soil layer to make water stopping connection and form a submarine tunnel (immersed tube method). This tunnel has been gradually adopted due to its characteristics of construction quality assurance, strong adaptability to geological and hydrological conditions, short construction period, low project cost and the like, such as submarine immersed tube tunnel of Hong Kong-Zhuhai-Macao Bridge. However, the submarine tunnel formed by the immersed tube method and the submarine tunnel formed by the excavation method need to be attached to the submarine soil layer. The depth of the tunnel is affected by the depth of the seabed. If the seabed is deeper, the tunnel is also deeper. Due to the limitation of slope, approaches on two shores of the tunnel will be lengthened, so the project cost will be increased. In addition, the tunnel formed by the immersed tube method needs to be subjected to water stopping connection in water. At a certain depth, water pressure is too high, causing that the technical difficulty of leakage prevention is increased and even the project cannot be implemented due to the limitation of diving depth. Therefore, from the perspectives of economic benefits and technical difficulty, the immersed tube method and the excavation method are not applicable to the construction of tunnels in deep water.

Because of the natural force, i.e., the buoyancy, a submerged floating tunnel has advantages and characteristics that the existing bridges and tunnels do not have: 1. the tunnel adopts an environmental-friendly solution which has small effect on the landform of two shores; 2. the tunnel has the advantage of construction cost compared with the bridges and the tunnels, and the construction cost of the tunnel per unit length is not increased with the increase of span; and 3. the tunnel is not limited by span and water depth, and can be built in steep places with long span and deep water level. Therefore, it is of great significance to study the submerged floating tunnel, which is also the foundation engineering of a cross-sea high-speed railway.

The submerged floating tunnel is floated in water by means of the buoyancy and is supported in three ways: I. a buoy structure: when the buoyancy of a suspended pipeline is small, the buoy is used to increase the buoyancy; II. a riveting cable structure: when the buoyancy of the pipeline is large enough, a riveting cable is used to fix the pipeline; and III. a rigid pile structure: like a bridge in water.

For a high-speed railway tunnel (single track) with an internal diameter of about 5.2 m, the buoyancy of the tunnel is generally greater than the gravity of the tunnel. Therefore, for the cross-sea high-speed railway tunnel, the above supporting modes hardly exist. The supporting modes II and III adopt the riveting cable or a pile column for fixation to the seabed. For the deep sea, construction is almost impossible, just like the immersed tube method mentioned above. In addition, there are also safety problems of anchorage mode and anchorage structure, i.e., vortex-induced vibration (VIV) occurs in an anchorage system under the action of water flow. This has a great influence on the fixation strength of the riveting cable on the seabed.

Besides the above supporting problem, the design and construction of the submerged floating tunnel also have all the problems encountered in ocean engineering, including the following obvious problems: stability of the tunnel under the action of ocean currents, durability of tunnel (material), and safety of structures and personnel. In addition, the tunnel serves the high-speed railway, and the problem of precise control of track flatness necessary for the operation of the super high-speed railway is most important.

SUMMARY OF PRESENT INVENTION

The present disclosure provides a sea-cross high-speed tunnel structure suspended in water, a construction method and a control method thereof, so as to solve the problems of design and construction of a sea-cross tunnel suspended in water, stability, durability and safety of the tunnel; and accuracy control of a high-speed railway in the tunnel.

A specific implementation solution of the present disclosure is as follows: a sea-cross high-speed tunnel structure suspended in water comprises a pipe body capable of suspending in water, wherein the pipe body is formed by fixedly connecting a plurality of pipe sections; a reinforced concrete horizontal partition plate for dividing each pipe section to form an upper chamber and a lower chamber is fixed in each pipe section; two closed tunnels arranged along a length direction of the pipe body are disposed in the upper chamber; reinforced concrete fin plates are symmetrically disposed in a horizontal direction outside the pipe sections; a steel closed tunnel shell fixed to the reinforced concrete horizontal partition plate is disposed in the upper chamber; a rail bed is disposed in the steel closed tunnel shell; electromagnetic regulating devices disposed transversely are fixedly connected between both sides of the rail bed and the steel closed tunnel shell; and electromagnetic regulating devices disposed vertically are fixedly connected between both sides of the lower part of the rail bed and the reinforced concrete horizontal partition plate.

Preferably, each of the pipe sections is formed by pouring steel slag concrete with corrosion resistance and high volumetric weight; the cross section of the pipe section is circular; in a pipe wall of the pipe section, a steel bar is arranged and a steel plate is embedded; an inner surface and an outer surface of the pipe section are coated with corrosion-resistant layers; each of the corrosion-resistant layers is one or more layers of an epoxy resin coating, a petroleum pitch coating, a polyethylene adhesive tape and a polyolefin coating; and the weight of the pipe section is less than the buoyancy of the pipe section when completely immersed in water.

Preferably, an outer turning circular ring and an inner turning circular ring are extended from an end part of each pipe section; bolt holes are distributed on the outer turning circular ring and the inner turning circular ring; adjacent pipe sections are fixedly connected through a bolt that penetrates through the bolt holes of the adjacent pipe sections; an inner ring rubber water stopping plate and an outer ring rubber water stopping plate are disposed between matching surfaces of adjacent pipe sections; a gap is reserved between the inner ring rubber water stopping plate and the outer ring rubber water stopping plate; grouting sleeve valve pipes inserted into the gap are uniformly distributed along a circumference direction in the inner ring rubber water stopping plate; picking ears are symmetrically disposed on an outer side of the end part of each pipe section; opposite end surfaces of the picking ears of adjacent pipe sections have a groove and a tenon which are matched with each other; and positioning bolts are penetrated on the picking ears of adjacent pipe sections.

Preferably, two end surfaces of each pipe section are connected with a detachable steel sealing plate; and the sealing plate is fixed to an inner side of the inner turning circular ring through a sealing plate fixing bolt to ensure that the interior of each pipe section is hollow during transportation.

Preferably, each of the reinforced concrete fin plates includes electromagnetic propulsion devices disposed horizontally on both sides of the reinforced concrete fin plate and disposed vertically on an outer end part of the reinforced concrete fin plate; each of the electromagnetic propulsion devices comprises a drainage pipe, an electromagnet wound on the periphery of the drainage pipe and formed by a coil made of conductive material, and an electrode plate fixed to an opposite side in the drainage pipe; a magnetic field direction generated by the electromagnet is perpendicular to a current direction between the electrode plates; and the reinforced concrete fin plate is provided with a position sensor.

Preferably, electromagnetic regulating devices disposed transversely are fixedly connected between both sides of the rail bed and the steel closed tunnel shell; and electromagnetic regulating devices disposed vertically are fixedly connected between both sides of the lower part of the rail bed and the reinforced concrete horizontal partition plate; a starting point of a steel closed tunnel is provided with a laser transmitter; laser light is emitted to an end point of the steel closed tunnel; all laser beams are parallel; and the electromagnetic regulating devices are controlled by independent laser beams.

Each of the electromagnetic regulating devices is composed of a moving rod, a shell body and a power system.

Part of an inner chamber of the shell stores magnetorheological fluid; shells of the electromagnetic regulating devices positioned on the lower part of the rail bed are vertically fixed to the reinforced concrete horizontal partition plates; and shells of the electromagnetic regulating devices positioned on both sides of the rail bed are horizontally fixed to the steel closed tunnel shell; and the shells are rigid and non-magnetic.

The moving rod is composed of a permanent magnet, a magnetic isolating body and an inserting rod; the inserting rod is fixedly connected with the permanent magnet through the magnetic isolating body; the permanent magnet of the moving rod is fixedly connected with the rail bed; the inserting rod of the moving rod is inserted into the magnetorheological fluid and does not come into contact with the shell; the top height of the magnetorheological fluid is not greater than that of the inserting rod; and a guiding device for constraining the moving rod to move along a straight line is disposed in the shell.

A first power system is disposed outside the shell where the permanent magnet is located; the first power system comprises two groups of identical wires for magnets wound to the shell in the position; each group of wires for magnets is connected with a photoresistor and a first direct current power supply in series to form first independent loop; and current directions of two loops are opposite.

A second power system is disposed outside the shell where the magnetorheological fluid is located; the second power system comprises two groups of identical wires for magnetorheology wound to the shell in the position; the first group of wires for magnetorheology is connected with a second direct current power supply in the system in series to form a second independent circuit loop; a second group of wires for magnetorheology is connected with a third direct current power supply in the system and two photoresistors in parallel to form a third independent circuit loop; current directions of two loops are opposite; and if any one of the photoresistors is irradiated by laser light, the third independent circuit loop is energized.

In the second power system, the second independent circuit loop is always energized to solidify the magnetorheological fluid; the inserting rod is fixed into the magnetorheological fluid; when the third independent circuit loop is energized, magnetic fields generated by the second independent circuit loop and the third independent circuit loop cancel each other; the magnetorheological fluid is liquefied; the inserting rod is not constrained in the shell; and the moving rod is movable under the effect of an electromagnetic force of the first power system.

Two photoresistors of the electromagnetic regulating devices are fixed to the rail bed; when light beams of the laser transmitter irradiate one photoresistor, the first power system in which the photoresistor is positioned and the third independent circuit loop of the second power system are connected to generate an electromagnetic force opposite to the directions of the laser beams for the permanent magnet; under the effect of the electromagnetic force, the moving rod drives a rail bed control point to move; until the rail bed moves in place, the laser beams do not irradiate the photoresistor, and the first power system and the third independent circuit loop of the second power system are disconnected; the permanent magnet is not stressed; the magnetorheological fluid is solidified; and the moving rod stops moving.

Preferably, the upper chamber and the lower chamber are independently provided with an illuminating lamp, a ventilator, a power supply pipeline, a smoke sensor, a spray device, a monitor and other lines; and the lower chamber is divided by vertical partition plates into a maintenance warehouse, a facility warehouse and a ballast warehouse.

Preferably, a liquid nitrogen storage tank and a pipeline with a control valve connected with the liquid nitrogen storage tank are distributed in each pipe section; a temperature-humidity sensor is distributed in the pipe body and is connected with a control circuit, i.e., the control valve; and when the temperature-humidity sensor monitors that a humidity in the pipe section exceeds a control threshold, the control valve of the liquid nitrogen storage tank is turned on immediately for freezing and triggering the pipe body to alarm.

The present disclosure also includes a construction method of the sea-cross high-speed tunnel structure suspended in water, including the following steps:

(1) dividing the total length of the tunnel into a plurality of sections; each section comprising a plurality of standard pipe sections; respectively prefabricating standard pipe sections on land at both ends of the sea-cross tunnel according to design requirements; symmetrically and fixedly connecting reinforced concrete fin plates which are integrated with the pipe sections at both sides of the pipe sections; fixing steel sealing plates for temporarily closing each pipe section at inner sides of both ends of the pipe sections, wherein a dead weight of the fabricated standard pipe sections is slightly smaller than the buoyancy;

(2) fixing the steel sealing plates on both ends of each standard pipe section with bolts and then delivering into inshore water one by one; grooves and tenons of the picking ears on the outer sides of the end parts of adjacent pipe sections are used for butt joint of the pipe sections and then installing and positioning the bolts; and installing the bolts between the outer turning circular ring and the inner turning circular ring of adjacent standard pipe sections preliminarily to form pipe section segments;

(3) towing the pipe section segments to sea with a towing wheel; enable every two pipe section segments to form butt joint in the mode of step (2) to form a long tunnel;

(4) locking all the pipe sections with bolts; removing temporary fixing bolts used for fixing the steel sealing plates; and removing the steel sealing plates so that the tunnel in each pipe section is penetrated;

(5) connecting the horizontal partition plates and the vertical partitions of the reinforced concrete at the joints of the pipe sections into a whole by cast-in-place concrete;

(6) installing the steel closed tunnel shell, electromechanical equipment, the sensors and a liquid nitrogen storage tank device, and installing the electromagnetic regulating devices at the lower part of the rail bed, the rail bed and the electromagnetic regulating devices on both sides of the rail bed;

(7) uniformly placing lead blocks and other counterweights in the ballast warehouse of the tunnel so that the total weight of the pipe sections of the tunnel is equivalent to the buoyancy;

(8) slowly lowering the tunnel to a predetermined depth by means of an external force or an electromagnetic propulsion device;

(9) inspecting the seepage and leakage among the pipe sections of the tunnel; if necessary, using the grouting sleeve valve pipes to grout and block the pipe sections with polyurethane or other waterproof materials until there is no leakage among the pipe sections;

(10) staring the electromagnetic propulsion devices in the reinforced concrete fin plates according to Beidou navigation or GPS navigation information; and regulating the axial position of the tunnel; and

(11) starting an electromagnetic regulating device of the rail bed of the high-speed railway, and regulating the flatness of the rail bed to the operation requirements of the high-speed railway.

The present disclosure also includes a control method using the sea-cross high-speed tunnel structure suspended in water, including pipe section stability control and rail bed precision control of a high-speed railway, with the steps as follows:

pipe section stability control: the electromagnetic propulsion devices disposed in the reinforced concrete fin plates on both sides of the pipe sections are used for pipe section stability control; in case of ocean current disturbance, a strong magnetic field can be formed in the seawater in the drainage pipe after the electromagnetic coil is energized; after the electrode plate is applied with voltage, current is generated in the seawater in the drainage pipe, and the current interacts with the magnetic field to generate Lorentz force; the force acts on the seawater carrying the current and enables the seawater to flow axially along the drainage pipe; the fin plates and the tunnel are subjected to the reaction force of the seawater; the horizontally installed electromagnetic propulsion devices generate horizontal force on the seawater in the drainage pipe, and the vertically installed electromagnetic propulsion devices generate vertical force on the seawater in the drainage pipe, thereby balancing the horizontal force of the ocean current and the vertical unbalanced force of the tunnel.

The position sensors disposed on the reinforced concrete fin plates are used to feed back position information in real time through a Beidou navigation satellite system or a GPS navigation system; the voltage and the current in the electromagnetic propulsion devices are changed to control the overall structure of the tunnel; and control accuracy is in centimeters.

The thrust is controlled by regulating the voltage and the current; the direction of thrust is controlled by changing the polarity of the voltage, i.e., the direction of the current; control time is in milliseconds.

Rail bed precision control of high-speed railway: a first power system is disposed outside the shell where the permanent magnet is located; the first power system comprises two groups of identical wires for magnets wound to the shell in the position; one group of wires for magnets is connected with a photoresistor and a first direct current power supply in series to form a first independent loop; and current directions of two loops are opposite.

A second power system is disposed outside the shell where the magnetorheological fluid is located; the second power system comprises two groups of identical wires for magnetorheology wound to the shell in the position; the first group of wires for magnetorheology is connected with a second direct current power supply in the system in series to form a second independent circuit loop; a second group of wires for magnetorheology is connected with a third direct current power supply in the system and two photoresistors in parallel to form a third independent circuit loop; current directions of two loops are opposite; and if any one of the photoresistors is irradiated by laser light, the third independent circuit loop is energized.

In the second power system, the second independent circuit loop is always energized to solidify the magnetorheological fluid; the inserting rod is fixed into the magnetorheological fluid; when the third independent circuit loop is energized, magnetic fields generated by the second independent circuit loop and the third independent circuit loop in the shell; and the moving rod is movable under the effect of an electromagnetic force of the first power system.

Two photoresistors of the electromagnetic regulating devices are fixed to the rail bed; when light beams of the laser transmitter irradiate one photoresistor, the first power system in which the photoresistor is positioned and the third independent circuit loop of the second power system are connected to generate an electromagnetic force opposite to the directions of the laser beams for the permanent magnet; under the effect of the electromagnetic force, the moving rod drives a rail bed control point to move; until the rail bed moves in place, the laser beams do not irradiate the photoresistor, and the first power system and the third independent circuit loop of the second power system are disconnected; the permanent magnet is not stressed; the magnetorheological fluid is solidified; and the moving rod stops moving.

Compared with the prior art, the present disclosure has the following beneficial effects:

1. The suspended tunnel adopted by the present disclosure uses the buoyancy of water and has advantages and characteristics that the existing bridges and tunnels do not have: (1) the suspended tunnel adopts an environmental-friendly solution which has small effect on the landform of two shores; (2) the suspended tunnel has the advantage of construction cost compared with the bridges and the tunnels, and the construction cost of the suspended tunnel per unit length is not increased with the increase of span; and (3) the suspended tunnel is not limited by span and water depth, and can be built in steep places with long span and deep water level.

2. The present disclosure uses the buoyancy of seawater to balance the gravity of the pipe sections that form the tunnels and fixed equipment therein. Fin stabilizing plates provided with electromagnetic driving stabilizers are symmetrically disposed in the horizontal direction outside the pipe sections. The fin plates improve the anti-rotation and anti-fluctuation capabilities of the tunnels most effectively and play a stabilizing role. Under the positioning of the Beidou navigation (or GPS) system, the electromagnetic driving devices on the fin stabilizing plates are automatically controlled, so as to counter the role of ocean current and preliminarily ensure the horizontal position and stability of the pipe sections.

3. The high-speed railway tunnels are disposed in the pipe sections of the present disclosure. The rail bed of the high-speed railway in the tunnel is precisely controlled by a displacement sensor, a laser locator and magnetorheological automatic control equipment to ensure the accuracy of the high-speed railway rail. The pipe sections are divided into chambers and the high-speed railway tunnels are independently disposed. Contact channels are disposed between the chambers and the high-speed railway tunnels to enhance the safety of the pipe sections.

4. In addition, the liquid nitrogen storage tank and the sensor are disposed on each of the upper chamber and the lower chamber of each pipe section. When the water is sensed to enter the chamber, liquid nitrogen is released, and the seawater that enters the chamber is rapidly frozen, so that the risk only occurs in the pipe sections with problems, thereby ensuring the safety.

Figure 1:
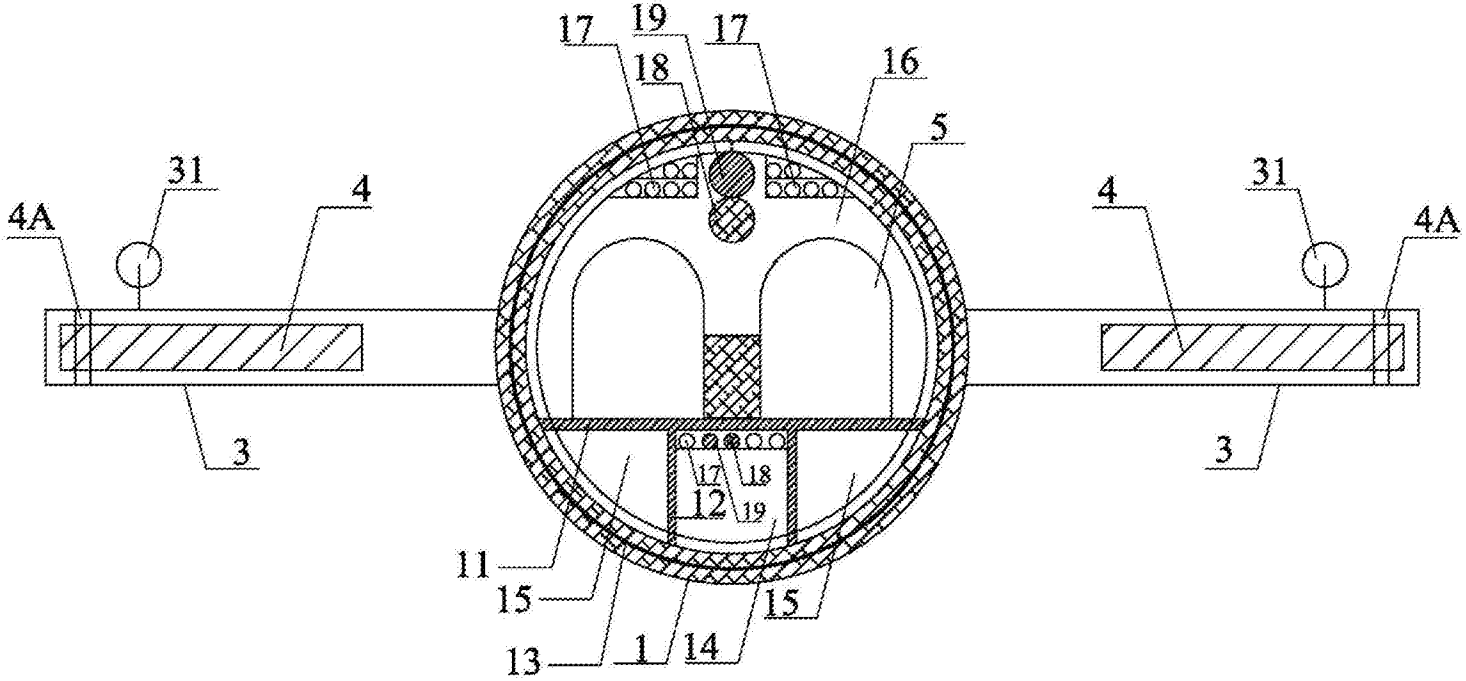
FIG. 1 is a cross-sectional view of a tunnel (pipe section) of the present disclosure.
Figure 2:
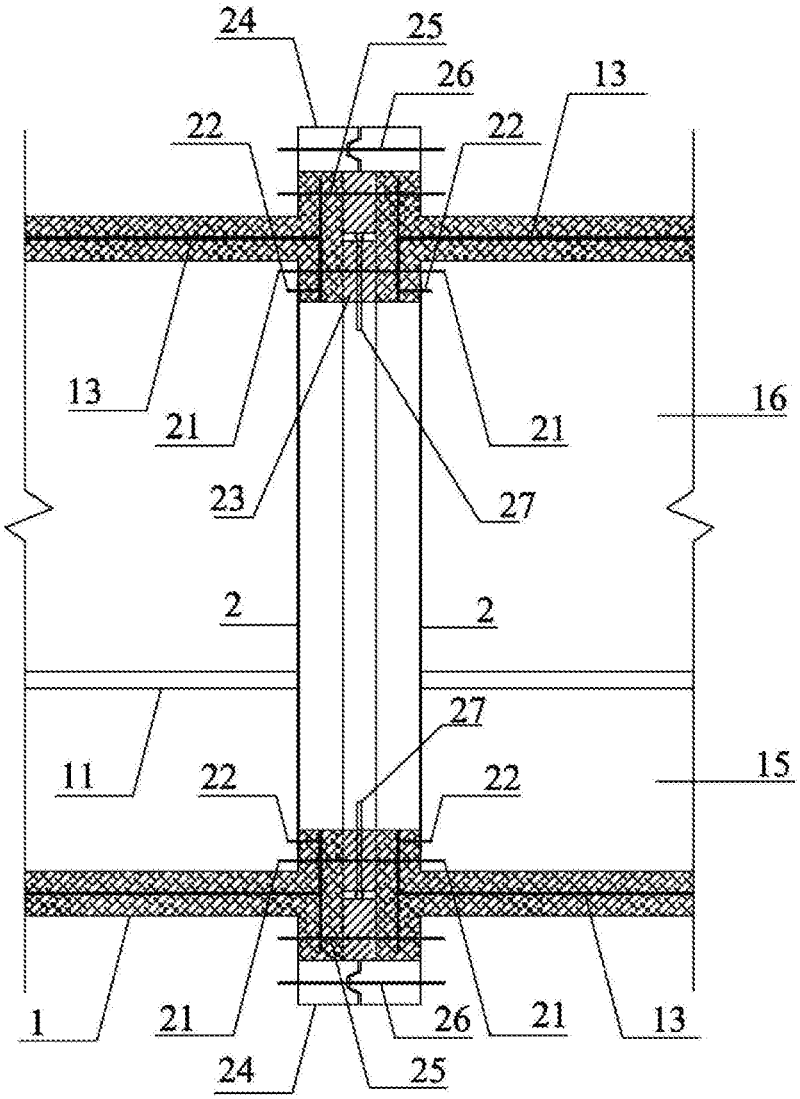
FIG. 2 is a longitudinal sectional view of a joint of pipe sections of the present disclosure.
Figure 3:
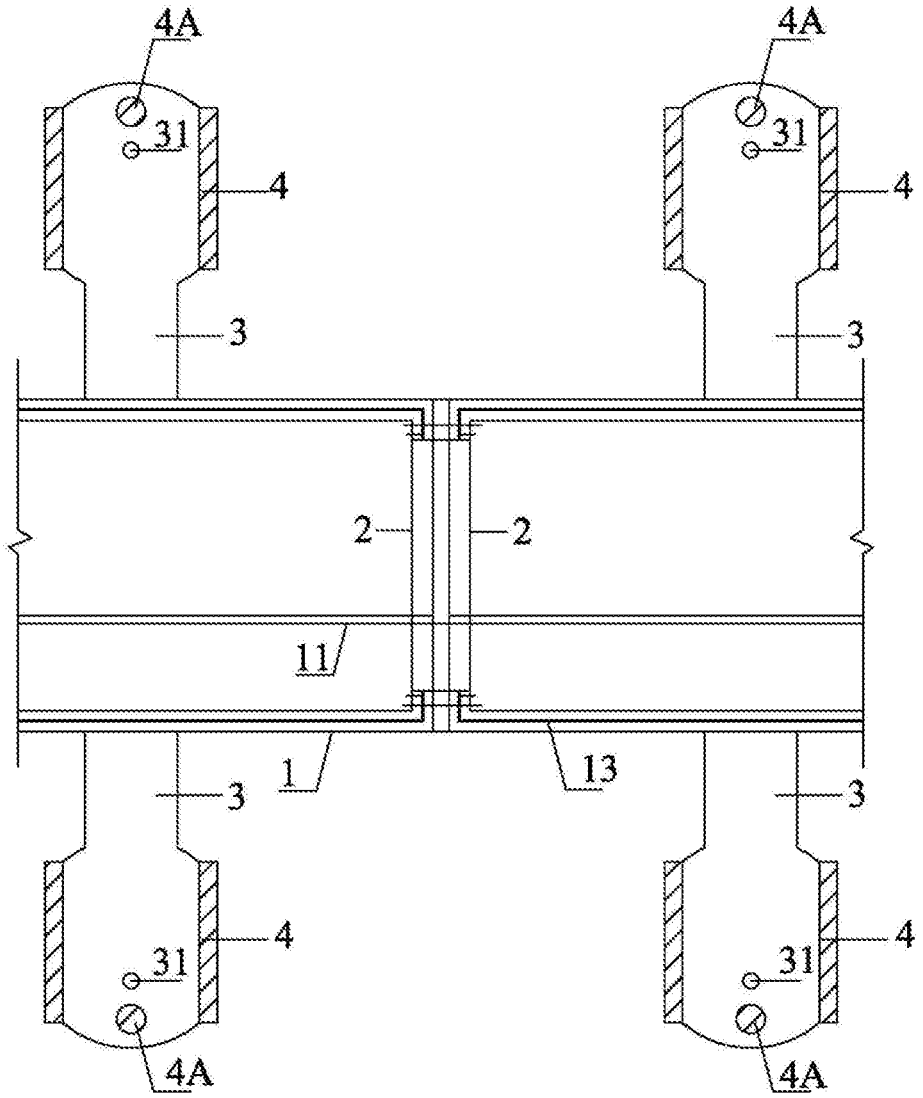
FIG. 3 is a top view of a tunnel (pipe section) of the present disclosure.
Figure 4:
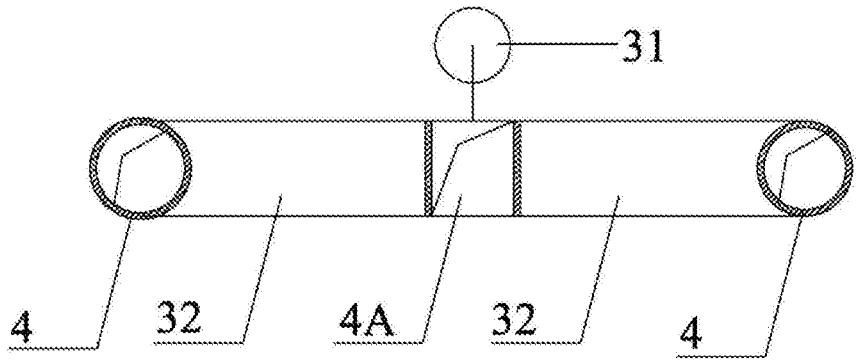
FIG. 4 is a cross-sectional view of a reinforced concrete fin plate of the present disclosure.
Figure 5:
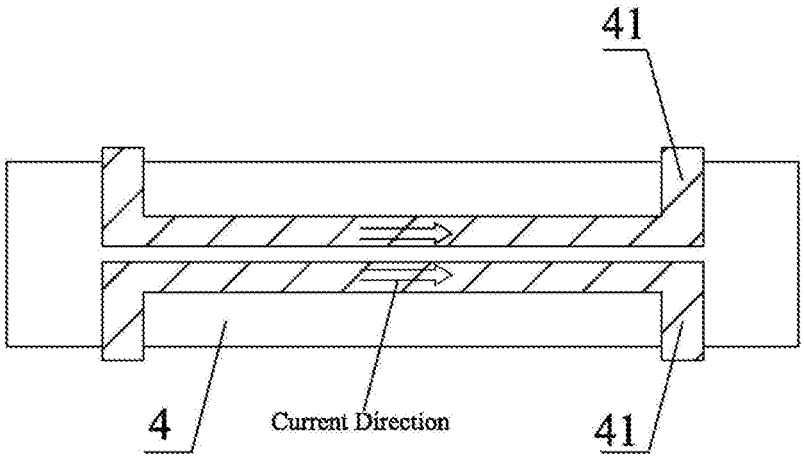
FIG. 5 is a longitudinal sectional view of an electromagnetic control drainage pipe of the present disclosure.
Figure 6:
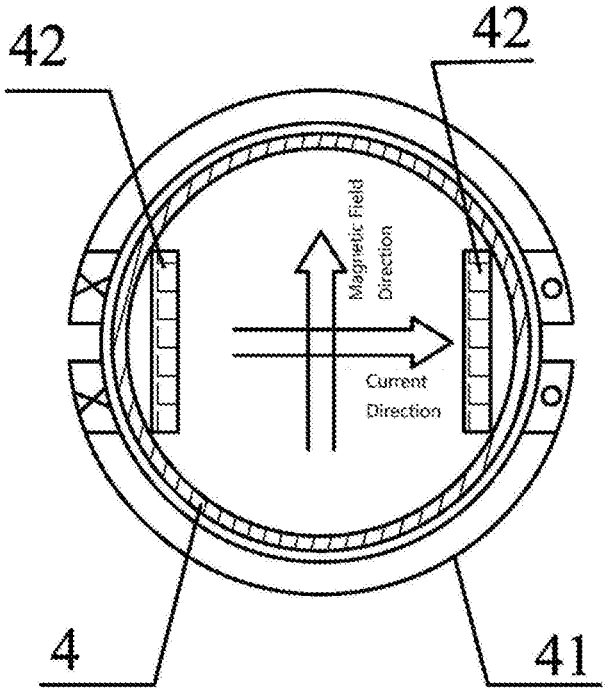
FIG. 6 is a cross-sectional view of an electromagnetic control drainage pipe of the present disclosure.

In the figures: 1 pipe section; 11 reinforced concrete horizontal partition plate; 12 reinforced concrete vertical partition plate; 13 steel pipe; 14 sealed maintenance warehouse; 15 facility warehouse, material warehouse and ballast warehouse; 16 upper chamber; 17 fire fighting pipeline, telecommunication pipeline and the like; 18 liquid nitrogen storage tank; 19 ventilating pipe;

2 steel sealing plate; 21 permanent bolt in pipe; 22 steel sealing plate fixing bolt; 23 rubber water stopping plate; 24 picking ear; 25 permanent bolt outside pipe; 26 installing and positioning bolt outside pipe; 27 grouting sleeve valve pipe;

3 reinforced concrete fin plate; 31 position sensor; 32 maintenance passage and electromechanical equipment warehouse;

4 drainage pipe; 41 saddle electromagnet; 42 electrode plate;

5 closed tunnel of high-speed railway; 51 steel closed tunnel shell; 52 steel pipe contact channel; 53 rail bed; 54 fastener; 55 rubber pad;

6 electromagnetic regulating device (vertically disposed); 6A electromagnetic regulating device (horizontally disposed); 61 wire for magnet; 61A wire for magnet; 62 wire for magnetorheology; 62A wire for magnetorheology; 63 permanent magnet; 64 magnetic isolating body; 65 inserting rod; 66 magnetorheological fluid; 67 shell; 68 moving rod; 69 guiding frame;

7 photoelectric control device; 7A photoelectric control device; 71 photoresistor A; and 72 photoresistor B.

DETAILED DESCRIPTION OF PREFERRED EMBODIMENTS

The present disclosure is further described below in detail in combination with drawings and specific embodiments.

As shown in FIGS. 1-9, a sea-cross high-speed tunnel structure suspended in water includes a pipe body capable of suspending in water, wherein the pipe body is formed by fixedly connecting a plurality of pipe sections 1; a reinforced concrete horizontal partition plate 11 for dividing each pipe section to form an upper chamber 16 and a lower chamber is fixed in each pipe section 1; two closed tunnels 5 of a high-speed railway arranged along a length direction of the pipe body are disposed in the upper chamber; rail beds 53 of the high-speed railway re disposed in the closed tunnels 5 of the high-speed railway; and reinforced concrete fin plates 3 are symmetrically disposed in a horizontal direction outside the pipe sections 1.

Figure 7:
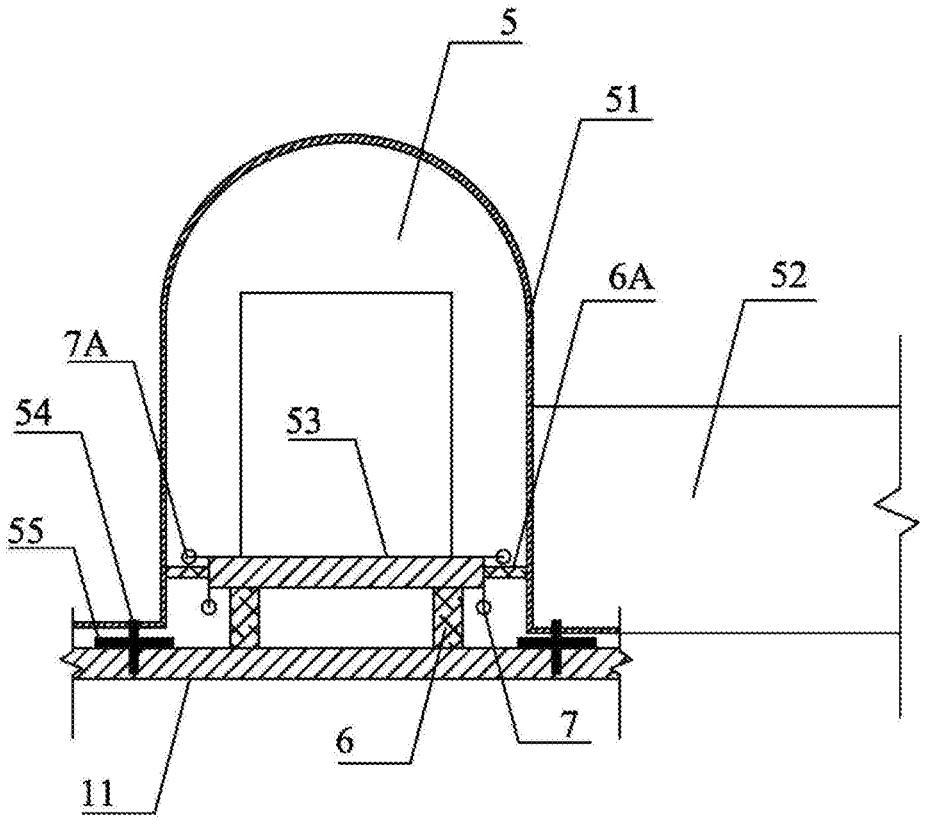
FIG. 7 is a cross-sectional view of a closed tunnel of a high-speed railway of the present disclosure.

In the present embodiment, from each section view of the pipe sectional view according to FIGS. 1 and 7, the two closed tunnels 5 of the high-speed railway are enclosed by a steel closed tunnel shell 51 fixed to a reinforced concrete horizontal partition plate in the upper chamber; a rail bed 53 is disposed in the steel closed tunnel shell 51. Two first electromagnetic regulating devices 6A are disposed transversely, in view of FIGS. 1 and 7, are fixedly connected between both sides of the rail bed 53 and the steel closed tunnel shell 51; and two second electromagnetic regulating devices 6 are disposed vertically are fixedly connected between both sides of the lower part of the rail bed and the reinforced concrete horizontal partition plate. The first electromagnetic regulating devices 6A and the second electromagnetic regulating devices are at least symmetrically disposed at both the beginning part and end part of a pipe section.

In the present embodiment, horizontal fixing plates are extended on both ends of the steel closed tunnel shell in the present embodiment; the horizontal fixing plates are fixed to the reinforced concrete horizontal partition plate 11 through longitudinal penetrating fasteners 54; and a rubber pad 55 is also disposed between the horizontal fixing plates and the reinforced concrete horizontal partition plate 11 to ensure internal sealing.

In the present embodiment, each of the pipe sections 1 is formed by pouring steel slag concrete with corrosion resistance and high volumetric weight; the cross section of the pipe section is circular; in a pipe wall of the pipe section, a steel bar is arranged and a steel pipe 13 is embedded; an inner surface and an outer surface of the pipe are coated with corrosion-resistant layers; each of the corrosion-resistant layers is one or more layers of an epoxy resin coating, a petroleum pitch coating, a polyethylene adhesive tape and a polyolefin coating; and the weight of the pipe section is less than the buoyancy of the pipe section when completely immersed in water.

An outer turning circular ring and an inner turning circular ring are extended from an end part of each pipe section; bolt holes are uniformly and symmetrically distributed on the outer turning circular ring and the inner turning circular ring; and adjacent pipe sections are fixedly connected through a bolt that penetrates through the bolt holes of the adjacent pipe sections.

In the present embodiment, two outer rows of bolt holes on adjacent pipe sections are in one-to-one correspondence and are fixedly connected through a bolt that penetrates through the bolt holes of the adjacent pipe sections, wherein the outer turning circular ring has a single row of bolt holes and the inner turning circular ring has double rows of bolt holes; and double rows of holes positioned on the outer side of the pipe sections respectively realize permanent fixation between the pipe sections through bolts. In the present embodiment, the outer turning circular ring is fixedly connected through a permanent bolt outside pipe 25, and the inner turning circular ring is fixed through a permanent bolt in pipe 21. The inner turning circular ring is also provided with a steel sealing plate 2 fixed through a steel sealing plate fixing bolt 22. The steel sealing plate 2 can ensure that the inner cavity of the pipe section 1 is closed during transportation. After a plurality of pipe sections are mutually connected, the steel sealing plate fixing bolt 22 is removed to realize the removal of the steel sealing plate 2. Then, related facilities and roads are paved in the tunnel. Specific required quantity of the bolts can be computed and determined through design.

In the present embodiment, rubber water stopping plates 23 are disposed between matching surfaces of adjacent pipe sections; the rubber water stopping plates include an inner ring rubber water stopping plate and an outer ring rubber water stopping plate; a gap is reserved between the inner ring rubber water stopping plate and the outer ring rubber water stopping plate; grouting sleeve valve pipes 27 inserted into the gap are uniformly distributed along a circumference direction in the inner ring rubber water stopping plate; the grouting sleeve valve pipes 27 can be used to grout and block the pipe sections with polyurethane or other waterproof materials until there is no leakage among the pipe sections.

To ensure that the adjacent pipe sections are easier to align and install, picking ears 24 made of reinforced concrete are symmetrically disposed on an outer side of the end part of each pipe section; opposite end surfaces of the picking ears of adjacent pipe sections have a groove and a tenon which are matched with each other; and installing and positioning bolts outside pipe 26 are penetrated on the picking ears of the adjacent pipe sections.

In the present embodiment, each of the reinforced concrete fin plates 3 includes electromagnetic propulsion devices 6A disposed horizontally on both sides of the reinforced concrete fin plate 3 and electromagnetic propulsion devices 6 disposed vertically on an outer end part of the reinforced concrete fin plate; each of the electromagnetic propulsion devices includes a drainage pipe 4, an electromagnet 41 wound on the periphery of the drainage pipe 4 and formed by a coil made of conductive material, and an electrode plate 42 fixed to an opposite side in the drainage pipe; a magnetic field direction generated by the electromagnet is perpendicular to a current direction between the electrode plates; and the reinforced concrete fin plate is provided with a position sensor 31.

In the present embodiment, the material of the reinforced concrete fin plate 3 is similar to that of the pipe section structure, both of which have steel bars and steel plates and are formed by pouring concrete. The steel bars or the steel plates in the reinforced concrete fin plate 3, and the steel plates in the pipe sections can be welded or formed integrally to ensure that the reinforced concrete fin plate 3 and the pipe sections form an integral structure.

During work, a strong magnetic field can be formed in the seawater in the drainage pipe after the electromagnetic coil is energized; after the electrode plate is applied with voltage, current is generated in the seawater in the drainage pipe, and the current interacts with the magnetic field to generate Lorentz force; the force acts on the seawater carrying the current and enables the seawater to flow axially along the drainage pipe; the fin plates and the tunnel are subjected to the reaction force of the seawater; the horizontally installed electromagnetic propulsion devices generate horizontal force on the seawater in the drainage pipe, and the vertically installed electromagnetic propulsion devices generate vertical force on the seawater in the drainage pipe, thereby balancing the horizontal force of the ocean current and the vertical unbalanced force of the tunnel.

In the present embodiment, the reinforced concrete fin plate 3 is adopted to realize the seawater diversion in the drainage pipe by electromagnetic propulsion mode, thereby effectively improving the anti-fluctuation capability of the pipe body. Under the positioning of the Beidou navigation (or GPS) system, the electromagnetic driving devices on the fin stabilizing plates are automatically controlled, so as to preliminarily ensure the horizontal position and stability of the pipe sections.

A fire fighting pipeline, telecommunication pipeline and the like 17, and a ventilation pipeline 19 are installed in the upper chamber 16, and a liquid nitrogen storage tank 18 are placed. A steel closed shell 52 fixed to the reinforced concrete horizontal partition plate 11 is disposed in the lower chamber. A rail bed 53 is disposed in the steel closed shell 52, while a maintenance passage and electromechanical equipment warehouse 32 is disposed below the reinforced concrete horizontal partition plate 11.

In the present embodiment, the high-speed railway is a conventional high-speed railway. In actual design, a vacuum tunnel can be adopted in order to reduce wind resistance according to the need of operation speed of the high-speed railway. The steel closed shell 52 can be communicated with vacuum-pumping equipment to realize vacuum in the closed tunnel of the high-speed railway.

A liquid nitrogen storage tank 18 and a pipeline with a control valve connected with the liquid nitrogen storage tank 18 are also distributed in each pipe section; a temperature-humidity sensor is distributed in the pipe body and is connected with a control circuit, i.e., the control valve; and when the temperature-humidity sensor monitors that a humidity in the pipe section exceeds a control threshold, the control valve of the liquid nitrogen storage tank 18 is turned on immediately for freezing and triggering the pipe body to alarm.

In the present embodiment, a starting point of the closed tunnel 5 of high-speed railway is provided with a laser transmitter; laser light is emitted to an end point of the tunnel 5; all laser beams are parallel; and the electromagnetic regulating devices are controlled by independent laser beams.

Each of the electromagnetic regulating devices is composed of a moving rod 68, a shell 67 and a power system.

Part of an inner chamber of the shell stores magnetorheological fluid 66; shells of the electromagnetic regulating devices 6 positioned on the lower part of the rail bed are vertically fixed to the reinforced concrete horizontal partition plates; and shells of the electromagnetic regulating devices 6A positioned on both sides of the rail bed are horizontally fixed to the steel closed tunnel shell 51; and the shells can ensure the rigidity and non-magnetic conductivity required by the force.

The moving rod 68 is composed of a permanent magnet 63, a magnetic isolating body 64 and an inserting rod 65; the inserting rod 65 is fixedly connected with the permanent magnet through the magnetic isolating body; one end of the inserting rod 65 is inserted into the shell and does not come into contact with the bottom surface of the shell; the permanent magnet is fixedly connected with the rail bed; the top height of the magnetorheological fluid is not greater than that of the inserting rod to prevent the permanent magnet from coming into contact with the magnetorheological fluid and causing morphological change of the magnetorheological fluid; a shell 67 fixed to the steel closed tunnel shell or the reinforced concrete horizontal partition plate is disposed outside the moving rod 68; and a guiding device for constraining the moving rod 68 to move along a straight line is disposed in the shell.

The guiding device may be a guiding rod that comes into contact with the moving rod or a guiding wheel structure.

A first power system is disposed outside the shell where the permanent magnet is located; the first power system includes two groups of identical wires for magnets wound to the shell in the position; each group of wires for magnets is connected with a photoresistor and a first direct current power supply in series to form a first independent loop; and current directions of the two first independent loops are opposite.

In the present embodiment, in the first power system disposed outside the shell where the permanent magnet 63 is located, one wire 61 is connected with the photoresistor A71; another wire 61A is connected with the photoresistor B72; each circuit is connected with a first independent direct current power supply in series; and current directions of the two first independent direct current power supplies are opposite.

A second power system is disposed outside the shell where the magnetorheological fluid is located; the second power system includes two groups of identical wires for magnetorheology wound to the outer part of the shell in the position and two independent power supplies; the first group of wires for magnetorheology is connected with a second direct current power supply in the system in series to form a second independent circuit loop; a second group of wires for magnetorheology is connected with a third direct current power supply in the system and two photoresistors in parallel to form a third independent circuit loop; current directions of the second independent circuit loop and the third independent circuit loop are opposite; and if any one of the photoresistors is irradiated by laser light, the third independent circuit loop is energized.

In the present embodiment, the shell where the magnetorheological fluid is located is wound with the wire for magnetorheology 62 and the wire for magnetorheology 62A; the wire for magnetorheology 62A is independently connected with the second direct current power supply of the second power supply system to form a second independent circuit loop; the wire for magnetorheology 62, two photoresistors and a third direct current power supply of the second power supply system form a third independent circuit loop; and the two photoresistors in the third independent circuit loop are connected in parallel.

In the second power system, the loop formed by the wire for magnetorheology 62A and the second direct current power supply in the second power system is always energized to solidify the magnetorheological fluid; the inserting rod is fixed into the magnetorheological fluid; when the loop formed by the wire for magnetorheology 62 and the third direct current power supply in the second power system is energized, magnetic fields generated by the second independent circuit loop and the third independent circuit loop cancel each other; the magnetorheological fluid is liquefied; the inserting rod is not constrained in the shell; and the moving rod is movable under the effect of an electromagnetic force of the first power system.

In the present embodiment, two photoresistors (photoresistor A71 and photoresistor B72) of the electromagnetic regulating devices are fixed to the rail bed; when light beams of the laser transmitter irradiate one photoresistor, the first power system in which the photoresistor is positioned and the third independent circuit loop of the second power system are connected to generate an electromagnetic force opposite to the directions of the laser beams for the permanent magnet; under the effect of the electromagnetic force, the moving rod drives a rail bed control point to move; until the rail bed moves in place, the laser beams do not irradiate the photoresistor, and the first power system and the third independent circuit loop of the second power system are disconnected; the permanent magnet is not stressed; the magnetorheological fluid is solidified; and the moving rod stops moving.

Figure 8:
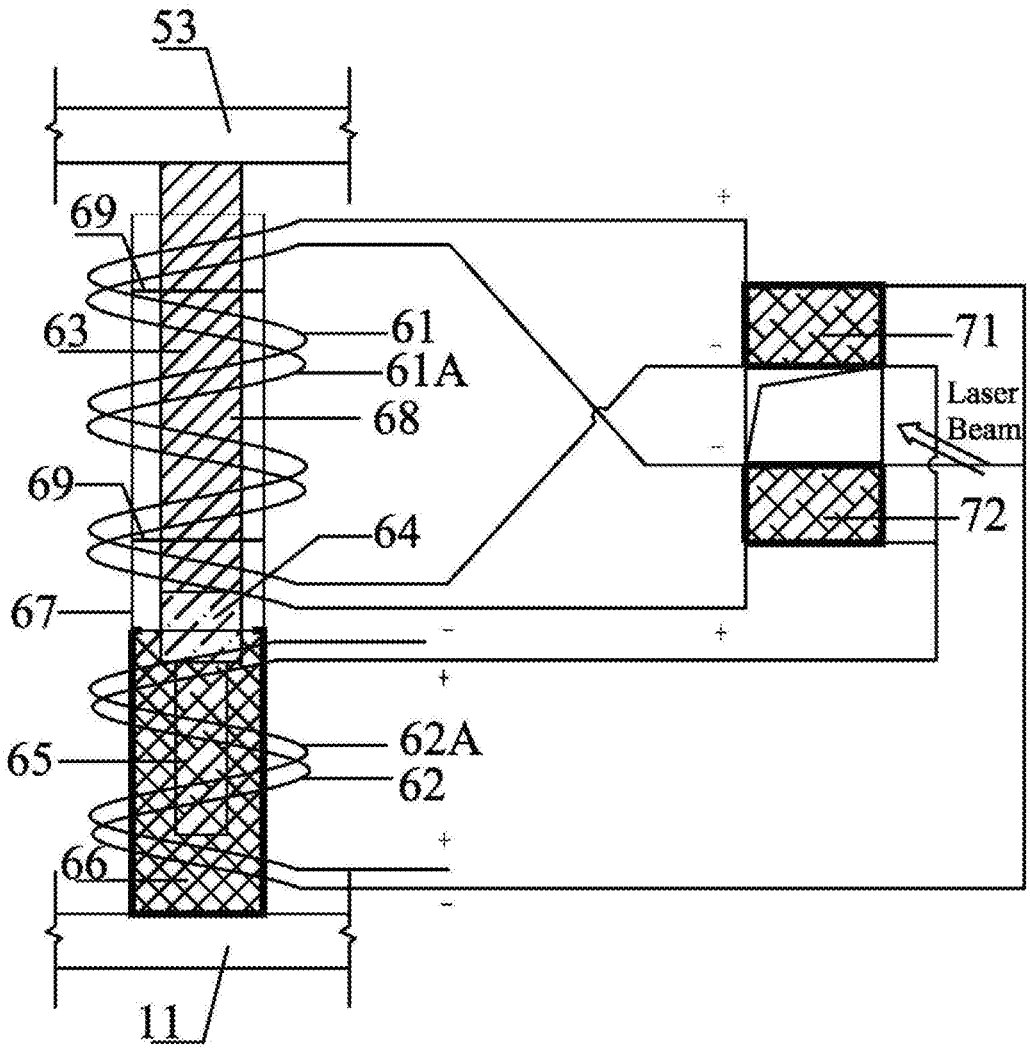
FIG. 8 is a sectional view of an electromagnetic control device of the present disclosure (at the lower part of a rail bed)
Figure 9:
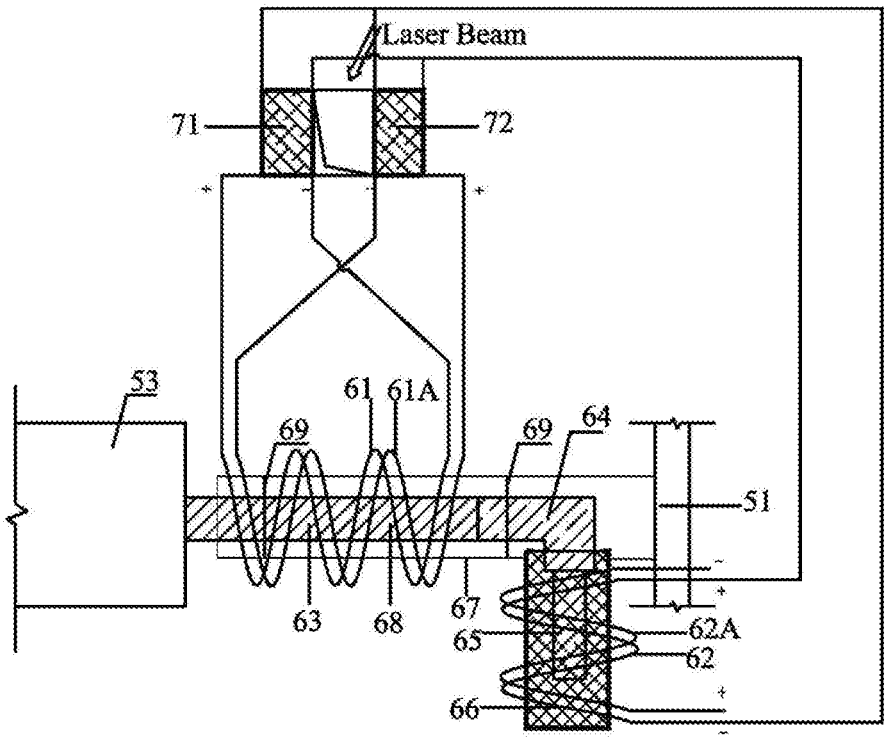
FIG. 9 is a sectional view of an electromagnetic control device of the present disclosure (on the right side of a rail bed).

As shown in FIG. 9, compared with the vertical shell in FIG. 8, in the present embodiment, the inserting rod 65 in the electromagnetic regulating device 6A installed horizontally is in a turned shape; the shell in the electromagnetic regulating device 6A installed horizontally is provided with a vertical cup body for containing the magnetorheological fluid to prevent the magnetorheological fluid from overflowing during liquidation. In addition, in actual design, a semi-closed method can also be adopted to control the overflow of the magnetorheological fluid during liquidation.

In addition, a guiding frame 69 fixed into the shell is disposed outside the moving rod 68. The guiding frame 69 is used for limiting the moving rod, thereby ensuring that the moving rod 68 moves along a straight line during movement.

A construction method of the sea-cross high-speed tunnel structure suspended in water includes the following steps:

(1) dividing the total length of the tunnel into a plurality of sections; each section comprising a plurality of standard pipe sections; respectively prefabricating standard pipe sections on land at both ends of the sea-cross tunnel according to design requirements; symmetrically and fixedly connecting reinforced concrete fin plates which are integrated with the pipe sections at both sides of the pipe sections; fixing steel sealing plates for temporarily closing each pipe section at inner sides of both ends of the pipe sections; and dead weight of the fabricated standard pipe sections being slightly smaller than the buoyancy;

(2) fixing the steel sealing plates on both ends of each standard pipe section with bolts and then delivering into inshore water one by one; grooves and tenons of the picking ears on the outer sides of the end parts of adjacent pipe sections are used for butt joint of the pipe sections and then installing and positioning the bolts; and installing the bolts between the outer turning circular ring and the inner turning circular ring of adjacent standard pipe sections preliminarily to form pipe section segments;

(3) towing the pipe section segments to sea with a towing wheel; enable every two pipe section segments to form butt joint in the mode of step (2) to form a long tunnel;

(4) locking all the pipe sections with bolts; removing temporary fixing bolts used for fixing the steel sealing plates; and removing the steel sealing plates so that the tunnel in each pipe section is penetrated;

(5) connecting the horizontal partition plates and the vertical partitions of the reinforced concrete at the joints of the pipe sections into a whole by cast-in-place concrete;

(6) installing the steel closed tunnel shell, electromechanical equipment, the sensors and a liquid nitrogen storage tank device, and installing the electromagnetic regulating devices at the lower part of the rail bed, the rail bed and the electromagnetic regulating devices on both sides of the rail bed;

(7) uniformly placing lead blocks and other counterweights in the ballast warehouse of the tunnel so that the total weight of the pipe sections of the tunnel is equivalent to the buoyancy;

(8) slowly lowering the tunnel to a predetermined depth by means of an external force or an electromagnetic propulsion device;

(9) inspecting the seepage and leakage among the pipe sections of the tunnel; if necessary, using the grouting sleeve valve pipes to grout and block the pipe sections with polyurethane or other waterproof materials until there is no leakage among the pipe sections;

(10) staring the electromagnetic propulsion devices in the reinforced concrete fin plates according to Beidou navigation or GPS navigation information; and regulating the axial position of the tunnel; and

(11) starting an electromagnetic regulating device of the rail bed of the high-speed railway, and regulating the flatness of the rail bed to the operation requirements of the high-speed railway.

In addition, a control method using the sea-cross high-speed tunnel structure suspended in water is also provided, including pipe section stability control and railway precision control, with the steps as follows:

pipe section stability control: the electromagnetic propulsion devices disposed in the reinforced concrete fin plates on both sides of the pipe sections are used for pipe section stability control; in case of ocean current disturbance, a strong magnetic field can be formed in the seawater in the drainage pipe after the electromagnetic coil is energized; after the electrode plate is applied with voltage, current is generated in the seawater in the drainage pipe, and the current interacts with the magnetic field to generate Lorentz force; the force acts on the seawater carrying the current and enables the seawater to flow axially along the drainage pipe; the fin plates and the tunnel are subjected to the reaction force of the seawater; the horizontally installed electromagnetic propulsion devices generate horizontal force on the seawater in the drainage pipe, and the vertically installed electromagnetic propulsion devices generate vertical force on the seawater in the drainage pipe, thereby balancing the horizontal force of the ocean current and the vertical unbalanced force of the tunnel.

The position sensors disposed on the reinforced concrete fin plates are used to feed back position information in real time through a Beidou navigation satellite system or a GPS navigation system; the voltage and the current in the electromagnetic propulsion devices are changed to control the overall structure of the tunnel; and control accuracy is in centimeters.

The thrust is controlled by regulating the voltage and the current; the direction of thrust is controlled by changing the polarity of the voltage, i.e., the direction of the current; control time is in milliseconds.

Rail bed precision control of high-speed railway: a first power system is disposed outside the shell where the permanent magnet is located; the first power system comprises two groups of identical wires for magnets wound to the shell in the position; one group of wires for magnets is connected with a photoresistor and a direct current power supply in series to form an independent loop; and current directions of two loops are opposite.

A second power system is disposed outside the shell where the magnetorheological fluid is located; the second power system comprises two groups of identical wires for magnetorheology wound to the shell in the position; the first group of wires for magnetorheology is connected with a first direct current power supply in the system in series to form a first independent circuit loop; a second group of wires for magnetorheology is connected with a second direct current power supply in the system and two photoresistors in parallel to form a second independent circuit loop; current directions of two loops are opposite; and if any one of the photoresistors is irradiated by laser light, the second group of circuit is energized.

In the second power system, the first group of circuit loop is always energized to solidify the magnetorheological fluid; the inserting rod is fixed into the magnetorheological fluid; when the second group of circuit loop is energized, magnetic fields generated by two groups of power supplies cancel each other, the magnetorheological fluid is liquefied; the inserting rod is not constrained in the shell; and the moving rod is movable under the effect of an electromagnetic force of the first power system.

Two photoresistors of the electromagnetic regulating devices are fixed to the rail bed; when light beams of the laser transmitter irradiate one photoresistor, the first power system in which the photoresistor is positioned and the second group of circuit of the second power system are connected to generate an electromagnetic force opposite to the directions of the laser beams for the permanent magnet; under the effect of the electromagnetic force, the moving rod drives a rail bed control point to move; until the rail bed moves in place, the laser beams do not irradiate the photoresistor, and the first power system and the second group of circuit of the second power system are disconnected; the permanent magnet is not stressed; the magnetorheological fluid is solidified; the moving rod stops moving; the control precision of the rail bed can reach 0.1 mm; the control time can be in milliseconds; the laser beams can be emitted at any time or at a fixed time according to needs; each electromagnetic regulating device is controlled by an independent laser beam; and the electromagnetic regulating devices work together to regulate the rail bed.

Unless otherwise stated, if any of the technical solutions disclosed by the present disclosure discloses a numerical range, the disclosed numerical range shall be a preferred numerical range. Any of those skilled in the art shall understand that: the preferred numerical range is only one of many implementable values where the technical effect is obvious or representative. Because there are too many values to enumerate, part of the numerical values are disclosed in the present disclosure to illustrate the technical solutions of the present disclosure with examples. Moreover, the values listed above shall not limit the protection scope of the present disclosure.

If"first", "second" and other words are used herein to define components, those skilled in the art shall know that the "first" and "second" words are only used for the convenience of distinguishing components in description, and the above words have no special meaning unless otherwise stated.

In addition, the term applied in any of the technical solutions disclosed by the present disclosure for the expression of position relationships or shapes includes, unless otherwise stated, a state or shape approximate to, similar to or close to that of the term.

Any component provided by the present disclosure may be assembled by multiple separate components or may be an independent component manufactured by an integral forming process.

Finally, it should be noted that the above embodiments are only used to illustrate the technical solution of the present disclosure, not to limit it. Although the present disclosure is described in detail with reference to preferred embodiments, those ordinary skilled in the art shall understand that the specific embodiments of the present disclosure can still be modified or some technical features can be replaced equally. Without departing from the spirit of the technical solution of the present disclosure, these embodiments shall be covered in the scope of the technical solution claimed in the present disclosure.

We claim:

1. A tunnel structure for the crossing of a high-speed vehicle system to cross a sea, comprising a pipe body capable of suspending in water, wherein the pipe body is formed by a plurality of pipe sections being connected in succession;

a reinforced concrete horizontal partition plate for dividing each pipe section to form an upper chamber and a lower chamber is fixed in each pipe section;

two tunnels arranged along a length direction of the pipe body are disposed in the upper chamber;

reinforced concrete fin plates are symmetrically disposed in a horizontal direction outside the pipe sections;

each of the two tunnels are formed by a steel tunnel shell being fixed to the reinforced concrete horizontal partition plate; the two tunnels are disposed in the upper chamber;

a rail bed is disposed in the tunnel, located onto the reinforced concrete horizontal partition plate;

each of the reinforced concrete fin plates comprises electromagnetic propulsion devices disposed horizontally on both sides of the reinforced concrete fin plate and disposed vertically on an outer end part of the reinforced concrete fin plate;

two first electromagnetic regulating devices and two second electromagnetic regulating devices are arranged in each of the two tunnels, for regulating the rail bed in at least two directions;

wherein the two first electromagnetic regulating devices are arranged along a width direction of the tunnel; each of the two first electromagnetic regulating devices is fixedly connected between one side of the rail bed and the steel tunnel shell; and the two second electromagnetic regulating devices are arranged along a height direction of the tunnel; each of the two second electromagnetic regulating devices is fixedly connected between a lower part of the rail bed and the reinforced concrete horizontal partition plate.

2. The tunnel structure for the crossing of a high-speed vehicle system to cross a sea according to claim 1, wherein each of the pipe sections is formed by pouring steel slag concrete with corrosion resistance and high volumetric weight; a cross section of the pipe section is circular; in a pipe wall of the pipe section, a steel bar is arranged and a steel plate is embedded; a corrosion-resistant layer is coated on an inner surface and an outer surface of the pipe section respectively; the corrosion-resistant layer is one or more layers of an epoxy resin coating, a petroleum pitch coating, a polyethylene adhesive tape and a polyolefin coating; and a weight of the pipe section is less than a buoyancy of the pipe section when completely immersed in water.

3. The tunnel structure for the crossing of a high-speed vehicle system to cross a sea according to claim 1, wherein an outer turning circular ring and an inner turning circular ring are extended from an end part of each pipe section respectively; bolt holes are distributed on the outer turning circular ring and the inner turning circular ring; adjacent pipe sections are fixedly connected through a bolt that penetrates through the bolt holes of the adjacent pipe sections; an inner ring rubber water stopping plate and an outer ring rubber water stopping plate are disposed between matching surfaces of adjacent pipe sections; a gap is reserved between the inner ring rubber water stopping plate and the outer ring rubber water stopping plate; grouting sleeve valve pipes inserted into the gap are uniformly distributed along a circumference direction in the inner ring rubber water stopping plate; picking ears are symmetrically disposed on an outer side of the end part of each pipe section; opposite end surfaces of the picking ears of adjacent pipe sections have a groove and a tenon matched with each other; and positioning bolts are penetrated on the picking ears of adjacent pipe sections.

4. The tunnel structure for the crossing of a high-speed vehicle system to cross a sea according to claim 1, wherein two end surfaces of each pipe section are respectively connected with a detachable steel sealing plate; and the sealing plate is fixed to an inner side of an inner turning circular ring through a sealing plate fixing bolt to ensure that an interior of each pipe section is hollow during transportation.

5. The tunnel structure for the crossing of a high-speed vehicle system to cross a sea according to claim 1, wherein each of the electromagnetic propulsion devices comprises a drainage pipe, an electromagnet wound on a periphery of the drainage pipe and formed by a coil made of conductive material, and an electrode plate fixed to opposite sides in the drainage pipe; a magnetic field direction generated by the electromagnet is perpendicular to a current direction between the electrode plates; and the reinforced concrete fin plate is provided with a position sensor.

6. The tunnel structure for the crossing of a high-speed vehicle system to cross a sea according to claim 5, wherein the first electromagnetic regulating devices are fixedly connected between both sides of the rail bed and the steel tunnel shell; and the second electromagnetic regulating devices are fixedly connected between both sides of the lower part of the rail bed and the reinforced concrete horizontal partition plate; a starting point of a steel tunnel is provided with a laser transmitter; laser light is emitted to an end point of the steel tunnel; all laser beams are parallel; and the first and second electromagnetic regulating devices are respectively controlled by independent laser beams;

each of the first and second electromagnetic regulating devices is composed of a moving rod, a shell body and a power system;

part of an inner chamber of the shell stores a magnetorheological fluid; shells of the second electromagnetic regulating devices positioned on the lower part of the rail bed are vertically fixed to the reinforced concrete horizontal partition plates; and shells of the first electromagnetic regulating devices positioned on both sides of the rail bed are horizontally fixed to the steel tunnel shell; and the shells are rigid and non-magnetic;

the moving rod is composed of a permanent magnet, a magnetic isolating body and an inserting rod; the inserting rod is fixedly connected with the permanent magnet through the magnetic isolating body; the permanent magnet of the moving rod is fixedly connected with the rail bed; the inserting rod of the moving rod is inserted into the magnetorheological fluid and does not come into contact with the shell; a top height of the magnetorheological fluid is not greater than that of the inserting rod; and a guiding device for constraining the moving rod to move along a straight line is disposed in the shell;

a first power system is disposed outside the shell where the permanent magnet is located; the first power system comprises two groups of identical wires for magnets wound to the shell; each group of wires for magnets is connected with a photoresistor and a first direct current power supply in series to form a first independent loop; and current directions of two loops are opposite;

a second power system is disposed outside the shell where the magnetorheological fluid is located; the second power system comprises two groups of identical wires for magnetorheology wound to the shell; the first group of wires for magnetorheology is connected with a second direct current power supply in the system in series to form a second independent circuit loop; a second group of wires for magnetorheology is connected with a third direct current power supply in the system and two photoresistors in parallel to form a third independent circuit loop; current directions of two loops are opposite; and if any one of the photoresistors is irradiated by laser light, the third independent circuit is energized;

in the second power system, the second independent circuit loop is energized to solidify the magnetorheological fluid; the inserting rod is fixed into the magnetorheological fluid; when the third independent circuit is energized, magnetic fields generated by the second independent circuit loop and the third independent circuit cancel each other, and the inserting rod is therefore free of constraints and the moving rod is movable under an effect of an electromagnetic force of the first power system; and two photoresistors of the first and second electromagnetic regulating devices are fixed to the rail bed; when light beams of the laser transmitter irradiate one photoresistor, the first power system in which the photoresistor is positioned and the third independent circuit loop of the second power system are connected and generate an electromagnetic force with a direction opposite to directions of the laser beams for the permanent magnet;

under the effect of the electromagnetic force, the moving rod drives a rail bed control point to move until the rail bed is moved in place; when the rail bed is moved in place, the laser beams stops irradiating the photoresistor, the first power system and the third independent circuit loop of the second power system are disconnected, and the permanent magnet is free of being stressed, the magnetorheological fluid is solidified, and the moving rod stops moving.

7. A control method using the tunnel structure for the crossing of a high-speed vehicle system to cross a sea according to claim 6, comprising pipe section stability control and rail bed precision control of the high-speed railway, with the steps as follows:

pipe section stability control: the electromagnetic propulsion devices disposed in the reinforced concrete fin plates on both sides of the pipe sections are used for pipe section stability control;

in case of ocean current disturbance, a strong magnetic field can be formed in the seawater in the drainage pipe after the electromagnetic coil is energized; after the electrode plate is applied with voltage, current is generated in the seawater in the drainage pipe, and the current interacts with the magnetic field to generate Lorentz force; the force acts on the seawater carrying the current and enables the seawater to flow axially along the drainage pipe; the fin plates and the tunnel are subjected to the reaction force of the seawater; the horizontally installed electromagnetic propulsion devices generate horizontal force on the seawater in the drainage pipe, and the vertically installed electromagnetic propulsion devices generate vertical force on the seawater in the drainage pipe, thereby balancing the horizontal force of the ocean current and the vertical unbalanced force of the tunnel;

the position sensors disposed on the reinforced concrete fin plates are used to feed back position information in real time through a Beidou navigation satellite system or a GPS navigation system; the voltage and the current in the electromagnetic propulsion devices are changed to control the overall structure of the tunnel; and control accuracy is in centimeters;

the thrust is controlled by regulating the voltage and the current; the direction of thrust is controlled by changing the polarity of the voltage, i.e., the direction of the current; control time is in milliseconds;

rail bed precision control of high-speed railway: a first power system is disposed outside the shell where the permanent magnet is located; the first power system comprises two groups of identical wires for magnets wound to the shell in the position; one group of wires for magnets is connected with a photoresistor and a direct current power supply in series to form an independent loop; and current directions of two loops are opposite;

a second power system is disposed outside the shell where the magnetorheological fluid is located; the second power system comprises two groups of identical wires for magnetorheology wound to the shell in the position; the first group of wires for magnetorheology is connected with a first direct current power supply in the system in series to form a first independent circuit loop; a second group of wires for magnetorheology is connected with a second direct current power supply in the system and two photoresistors in parallel to form a second independent circuit loop; current directions of two loops are opposite; and if any one of the photoresistors is irradiated by laser light, and then the second group of circuit is energized;

in the second power system, the first group of circuit loop is always energized to solidify the magnetorheological fluid; the inserting rod is fixed into the magnetorheological fluid; when the second group of circuit loop is energized, magnetic fields generated by two groups of power supplies cancel each other; the magnetorheological fluid is liquefied; the inserting rod is not constrained in the shell; and the moving rod is movable under the effect of an electromagnetic force of the first power system; and two photoresistors of the electromagnetic regulating devices are fixed to the rail bed; when light beams of the laser transmitter irradiate one photoresistor, the first power system in which the photoresistor is positioned and the second group of circuit of the second power system are connected to generate an electromagnetic force opposite to the directions of the laser beams for the permanent magnet; under the effect of the electromagnetic force, the moving rod drives a rail bed control point to move; until the rail bed moves in place, the laser beams do not irradiate the photoresistor, and the first power system and the second group of circuit of the second power system are disconnected; the permanent magnet is not stressed; the magnetorheological fluid is solidified; the moving rod stops moving; the control precision of the rail bed can reach 0.1 mm; the control time can be in milliseconds; the laser beams can be emitted at any time or at a fixed time according to needs; each electromagnetic regulating device is controlled by an independent laser beam; and the electromagnetic regulating devices work together to regulate the rail bed.

8. The tunnel structure for the crossing of a high-speed vehicle system to cross a sea according to claim 1, wherein the upper chamber and the lower chamber are independently provided with an illuminating lamp, a ventilator, a power supply pipeline, a smoke sensor, a spray device, and a monitor; and the lower chamber is divided by vertical partition plates into a maintenance warehouse, a facility warehouse and a ballast warehouse.

9. The tunnel structure for the crossing of a high-speed vehicle system to cross a sea according to claim 1, wherein a liquid nitrogen storage tank and a pipeline with a control valve connected with the liquid nitrogen storage tank are distributed in each pipe section; a temperature-humidity sensor is distributed in the pipe body and is connected with a control circuit, i.e., the control valve; and when the temperature-humidity sensor monitors that a humidity in the pipe section exceeds a control threshold, the control valve of the liquid nitrogen storage tank is turned on immediately for freezing and triggering the pipe body to alarm.

10. A construction method of the tunnel structure for the crossing of a high-speed vehicle system to cross a sea according to claim 1, comprising the following steps:

(1) dividing a tunnel into a plurality of sections at intervals along a longitudinal axis of the tunnel; each section comprising a plurality of standard pipe sections; respectively prefabricating standard pipe sections on land at both ends of the sea-cross tunnel according to design requirements; symmetrically and fixedly connecting reinforced concrete fin plates which are integrated with the pipe sections at both sides of the pipe sections; fixing steel sealing plates for temporarily closing each pipe section at inner sides of both ends of the pipe sections, wherein a dead weight of the fabricated standard pipe sections is slightly smaller than a buoyancy thereof;

(2) fixing the steel sealing plates on both ends of each standard pipe section with bolts and then delivering into inshore water one by one; grooves and tenons of the picking ears on the outer sides of the end parts of adjacent pipe sections are used for butt joint of the pipe sections and then installing and positioning the bolts; and installing the bolts between an outer turning circular ring and an inner turning circular ring of adjacent standard pipe sections preliminarily to form pipe section segments;

(3) towing the pipe section segments to sea with a towing wheel; enable every two pipe section segments to form butt joint in the mode of step (2) to form a long tunnel;

(4) locking all the pipe sections with bolts; removing temporary fixing bolts used for fixing the steel sealing plates; and removing the steel sealing plates so that the tunnel in each pipe section is penetrated;

(5) connecting a horizontal partition plates and a vertical partitions of the reinforced concrete at the joints of the pipe sections into a whole by cast-in-place concrete;

(6) installing the steel tunnel shell, electromechanical equipment, the sensors and a liquid nitrogen storage tank device, and installing the electromagnetic regulating devices at the lower part of the rail bed, the rail bed and the electromagnetic regulating devices on both sides of the rail bed;

(7) uniformly placing lead blocks and other counterweights in a ballast warehouse of the tunnel so that the total weight of the pipe sections of the tunnel is equivalent to the buoyancy;

(8) slowly lowering the tunnel to a predetermined depth by means of an external force or an electromagnetic propulsion device;

(9) inspecting the seepage and leakage among the pipe sections of the tunnel; if necessary, using the grouting sleeve valve pipes to grout and block the pipe sections with polyurethane or other waterproof materials until there is no leakage among the pipe sections;

(10) staring the electromagnetic propulsion devices in the reinforced concrete fin plates according to Beidou navigation or GPS navigation information; and regulating the axial position of the tunnel; and

(11) starting an electromagnetic regulating device of the rail bed of a high-speed railway, and regulating the flatness of the rail bed to the operation requirements of the high-speed railway.

* * * * *